US012173247B2

(12) United States Patent
Zhao

(10) Patent No.: US 12,173,247 B2
(45) Date of Patent: Dec. 24, 2024

(54) REACTION PRODUCT OF AN ORGANIC AMINE AND GLYCIDOL AND ITS USE AS A FRICTION MODIFIER

(71) Applicant: Huntsman Petrochemical LLC, The Woodlands, TX (US)

(72) Inventor: Haibo Zhao, The Woodlands, TX (US)

(73) Assignee: HUNTSMAN PETROCHEMICAL LLC

( * ) Notice: Subject to any disclaimer, the term of this patent is extended or adjusted under 35 U.S.C. 154(b) by 0 days.

(21) Appl. No.: 18/039,500

(22) PCT Filed: Nov. 17, 2021

(86) PCT No.: PCT/US2021/059646
§ 371 (c)(1),
(2) Date: May 31, 2023

(87) PCT Pub. No.: WO2022/132364
PCT Pub. Date: Jun. 23, 2022

(65) Prior Publication Data

US 2024/0018440 A1 Jan. 18, 2024

Related U.S. Application Data

(60) Provisional application No. 63/126,112, filed on Dec. 16, 2020.

(51) Int. Cl.
*C10M 133/08* (2006.01)
*C10M 169/04* (2006.01)
(Continued)

(52) U.S. Cl.
CPC ..... *C10M 133/08* (2013.01); *C10M 169/04* (2013.01); *C10M 2215/042* (2013.01);
(Continued)

(58) Field of Classification Search
CPC ..... C10M 133/08; C10M 169/04; C10M 2215/042; C10M 159/12; C10N 2030/06; C10N 2030/54; C10N 2040/25
See application file for complete search history.

(56) References Cited

U.S. PATENT DOCUMENTS 3,933,659 A 1/1976 Lyle et al.
4,256,597 A 3/1981 Sakkab
(Continued)

FOREIGN PATENT DOCUMENTS

EP 0335701 A2 10/1989
EP 0747464 B1 7/2001
(Continued)

OTHER PUBLICATIONS

Extended European Search Report issued Mar. 26, 2024, in corresponding European Application No. 21907419.2.

*Primary Examiner* — Ellen M McAvoy
(74) *Attorney, Agent, or Firm* — HUNTSMAN PETROCHEMICAL LLC; Aleece Hayes

(57) ABSTRACT

The present disclosure generally relates to a friction modifier comprising the reaction product of an organic amine and glycidol and its use in a non-aqueous lubricant composition. There is also provided a method for reducing the friction between sliding parts of an engine by contacting the engine with the non-aqueous lubricant composition.

15 Claims, 2 Drawing Sheets

(51) Int. Cl.
*C10N 30/00* (2006.01)
*C10N 30/06* (2006.01)
*C10N 40/25* (2006.01)

(52) U.S. Cl.
CPC ..... *C10N 2030/06* (2013.01); *C10N 2030/54* (2020.05); *C10N 2040/25* (2013.01)

(56) References Cited

U.S. PATENT DOCUMENTS 4,617,137 A 10/1986 Plavac
4,683,069 A 7/1987 Brewster et al.
4,816,037 A * 3/1989 Horodysky ..... C10L 1/2225 44/434
4,943,672 A 7/1990 Hamner et al.
4,957,651 A 9/1990 Schwind
5,114,603 A 5/1992 Kennedy et al.
5,498,809 A 3/1996 Emert et al.
5,866,520 A 2/1999 Addagarla et al.
5,882,505 A 3/1999 Wittenbrink et al.
5,885,942 A 3/1999 Zhang et al.
6,013,171 A 1/2000 Cook et al.
6,080,301 A 6/2000 Berlowitz et al.
6,096,940 A 8/2000 Wittenbrink et al.
6,103,099 A 8/2000 Wittenbrink et al.
6,165,949 A 12/2000 Berlowitz et al.
6,180,575 B1 1/2001 Nipe
7,696,136 B2 4/2010 Migdal et al.
2006/0105922 A1 5/2006 Chase et al.
2006/0172899 A1* 8/2006 Tipton ..... C10M 169/045 508/545
2015/0337229 A1 11/2015 West
2017/0166826 A1* 6/2017 Culley ..... C10L 1/2225
2020/0039942 A1 2/2020 Takemoto et al.
2020/0140771 A1* 5/2020 Gunawan ..... C10M 141/06

FOREIGN PATENT DOCUMENTS

EP 0799883 B1 10/2001
EP 1367116 A1 12/2003
EP 3178909 A1 6/2017
WO 2008115726 A2 9/2008

* cited by examiner

REACTION PRODUCT OF AN ORGANIC AMINE AND GLYCIDOL AND ITS USE AS A FRICTION MODIFIER

CROSS-REFERENCE TO RELATED APPLICATION

This application is the National Phase of International Application PCT/US2021/059646 filed Nov. 17, 2021 which designated the U.S. and which claims priority to U.S. Provisional Application No. 63/126,112 filed Dec. 16, 2020. The noted application(s) are incorporated herein by reference.

STATEMENT REGARDING FEDERALLY SPONSORED RESEARCH OR DEVELOPMENT

Not applicable.

FIELD

The present disclosure generally relates to a friction modifier comprising the reaction product of: (i) an organic amine selected from an alkyl amine, an alicyclic amine, an aryl amine, an alkyl alkoxylated monoamine and a mixture thereof; and (ii) glycidol and its use in a non-aqueous lubricant composition to reduce the friction between sliding parts of an engine.

BACKGROUND

Engine oils play an important role in lubricating a variety of sliding parts in the engine, including, for example, piston rings/cylinder liners, bearings of crankshafts and connecting rods, and valve mechanisms (e.g., cams and valve lifters). Engine oils may also play a role in cooling the inside of an engine, dispersing combustion products, and inhibiting rust and corrosion.

The principal consideration for engine oils is to prevent wear and seizure of engine parts. Lubricated engine parts are mostly in a state of fluid lubrication. However, valve systems as well as the top dead center and bottom dead center of pistons are likely to be in a state of boundary and/or thin-film lubrication. The friction between such engine parts may cause significant energy losses and thereby reduce fuel efficiency. In order to improve fuel efficiency, friction between engine parts (e.g., the valve systems and portions of the pistons) must be reduced.

Organic friction modifiers are generally long molecules with a straight hydrocarbon chain consisting of at least 10 carbon atoms and a polar group at one end. The polar end group is one of the governing factors in the effectiveness of the molecules as a friction modifier. The common organic friction modifiers are esters of fatty acids and polyhydric alcohols, fatty acid amides, amines derived from fatty acids and organic dithiocarbamate or dithiophosphate compounds. For example, EP1367116, EP0799883, EP0747464, U.S. Pat. No. 3,933,659 and EP335701 disclose various organic friction modifiers that have been used in lubricants. Glycerol monooleate (GMO) is one of the most commonly used organic friction modifiers in lubricant compositions for engines, such as described in U.S. Pat. Nos. 5,885,942; 5,866,520; 5,114,603; 4,957,651; and 4,683,069.

Given the increasing fuel economy demands placed on engines, there remains a need to further improve the friction reduction and fuel economy of internal combustion engines utilizing lubricant compositions. It is therefore desirable to improve on the friction-reducing performance of known friction modifiers, such as glycerol monooleate, that have been commonly used in the art.

SUMMARY

The present disclosure relates to a friction modifier comprising, a reaction product of: (i) an amine selected from an alkyl amine, an alicyclic amine, an aryl amine, an alkyl alkoxylated monoamine and a mixture thereof; and (ii) glycidol. The friction modifier ma be combined with a base oil to form a non-aqueous lubricant composition for use in lubricating an engine.

Also provided is a method for reducing friction between sliding parts of an engine by contacting at least one of the sliding, parts with the non-aqueous lubricant composition.

Finally, there is provided a friction reducing additive package comprising the reaction product of the present disclosure and one or more additives.

DETAILED DESCRIPTION

Figure 1:
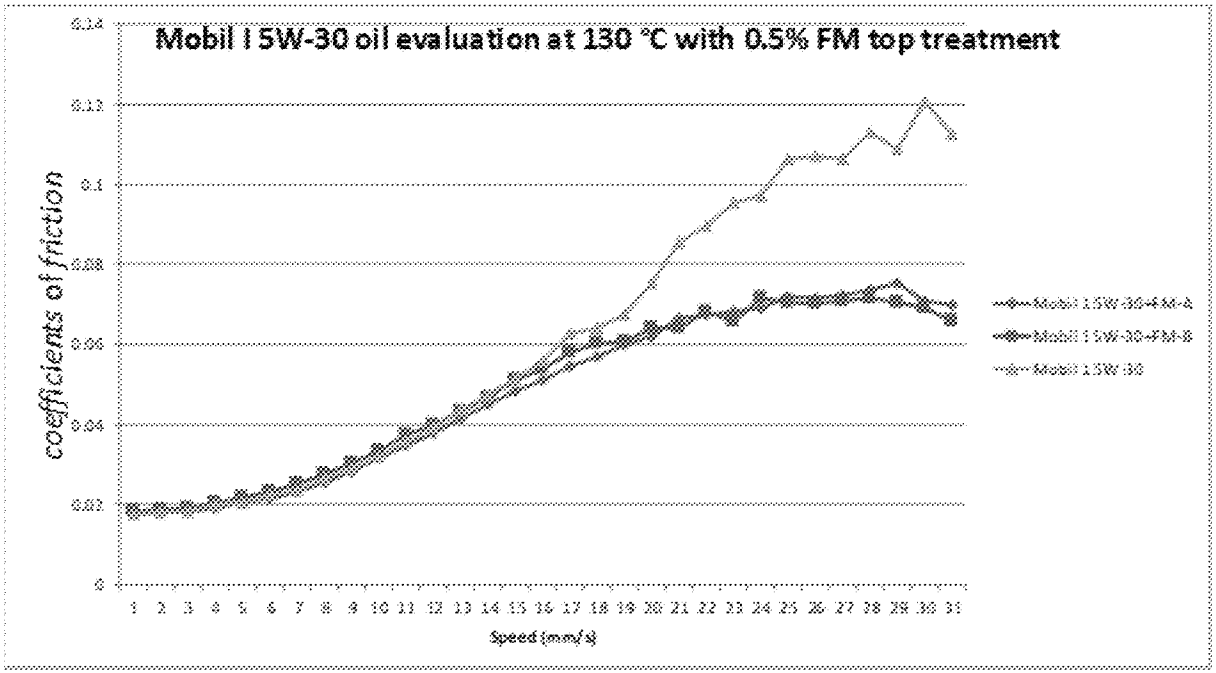
FIGS. 1 and 2 depict the coefficients of friction at 130° C. for commercial oil alone or in combination with the inventive friction modifiers.

The following terms shall have the following meanings:

The term "comprising" and derivatives thereof are not intended to exclude the presence of any additional component, step or procedure, whether or not the same is disclosed herein. In order to avoid any doubt, all compositions claimed herein through use of the term "comprising" may include any additional additive or compound, unless stated to the contrary. In contrast, the term, "consisting essentially of" if appearing herein, excludes from the scope of any succeeding recitation any other component, step or procedure, except those that are not essential to operability and the term "consisting of", if used, excludes any component, step or procedure not specifically delineated or listed. The term "or", unless stated otherwise, refers to the listed members individually as well as in any combination.

The articles "a" and "an" are used herein to refer to one or to more than one (i.e. to at least one) of the grammatical objects of the article. By way of example, "a friction modifier" means one friction modifier or more than one friction modifier. The phrases "in one embodiment", "according to one embodiment" and the like generally mean the particular feature, structure, or characteristic following the phrase is included in at least one embodiment of the present disclosure, and may be included in more than one embodiment of the present disclosure. Importantly, such phrases do not necessarily refer to the same aspect. If the specification states a component or feature "may", "can", "could", or "might" be included or have a characteristic, that particular component or feature is not required to be included or have the characteristic.

The term "about" as used herein can allow for a degree of variability in a value or range, for example, it may be within 10%, within 5%, or within 1% of a stated value or of a stated limit of a range.

Values expressed in a range format should be interpreted in a flexible manner to include not only the numerical values explicitly recited as the limits of the range, but to also include all of the individual numerical values or sub-ranges encompassed within that range as if each numerical value and sub-range is explicitly recited. For example, a range such as from 1 to 6, should be considered to have specifically disclosed sub-ranges, such as, from 1 to 3, from 2 to 4, from 3 to 6, etc., as well as individual numbers within that range, for example, 1, 2, 3, 4, 5, and 6. This applies regardless of the breadth of the range.

The terms "preferred" and "preferably" refer to embodiments that may afford certain benefits, under certain circumstances. However, other embodiments may also be preferred, under the same or other circumstances. Furthermore, the recitation of one or more preferred embodiments does not imply that other embodiments are not useful, and is not intended to exclude other embodiments from the scope of the present disclosure.

The term "substantially free" refers to a composition in which a particular compound or moiety is present in an amount that has no material effect on the composition. In some embodiments, "substantially free" may refer to a composition in which the particular compound or moiety is present in the composition in an amount of less than 2% by weight, or less than 1% by weight, or less than 0.5% by weight, or less than 0.1% by weight, or less than 0.05% by weight, or even less than 0.01% by weight based on the total weight of the composition, or that no amount of that particular compound or moiety is present in the respective composition.

Where substituent groups are specified by their conventional chemical formula, written from left to right, they equally encompass the chemically identical substituents that would result from writing the structure from right to left, for example, —$CH_2O$— is equivalent to —$OCH_2$—

The term "alkyl" refers to straight chain or branched chain saturated hydrocarbon groups having from 1 to about 100 carbon atoms. In some embodiments, alkyl substituents may be lower alkyl groups. The term "lower" refers to alkyl groups having from 1 to 3 carbon atoms. Examples of "lower alkyl groups" include, but are not limited to, methyl, ethyl, n-propyl and i-propyl.

The term "alicyclic" refers to an alicyclic substituent as is known in the art and may have from about 3 to about 12 ring carbon atoms or from about 3 to 10 ring carbon atoms, including, but not limited to, cyclopentyl and cyclohexyl.

The term "aryl" refers to an aryl substituent or functional group as is known in the art, such as, but not limited to, any substituent or functional group derived from an aromatic ring, including, but not limited to, phenyl, naphthyl, thienyl, and indolyl, and the like. The aryl group may be substituted on the ring by one or more alkyl groups.

The term "optional" or "optionally" means that the subsequently described event or circumstance may or may not occur, and that the description includes instances where said event or circumstance occurs and instances where it does not.

The present disclosure generally relates to a friction modifier comprising a reaction product of (i) an organic amine selected from an alkyl amine, an alicyclic amine, an aryl amine, an alkyl alkoxylated monoamine and a mixture thereof and (ii) glycidol.

The present disclose also relates to a friction reducing additive package including the friction modifier as disclosed herein and one or more additives.

The present disclosure further relates to a non-aqueous lubricant composition containing a base oil and the friction modifier as disclosed herein.

The present disclosure also relates to a method for reducing the friction in an engine by contacting the sliding parts of the engine with the non-aqueous lubricant composition.

It has been surprisingly found that when the friction modifiers of the present disclosure are combined with a base oil to form to the non-aqueous lubricant composition, the lubricity of the non-aqueous lubricant composition is increased and therefore the wear on engine surfaces or a part or component of an engine or an engine component part that is in contact with or has been contacted by the non-aqueous lubricant composition is greatly reduced.

According to one embodiment, the organic amine is an alkyl amine having a formula $N(R_1)_3$ where each $R_1$ is hydrogen or an alkyl group with the proviso that at least one $R_1$ is hydrogen. In one embodiment, at least one $R_1$ is a $C_1$-$C_{50}$ alkyl or a $C_1$-$C_{30}$ alkyl group. Examples of alkyl amines include, but are not limited to, ethylamine, propylamine, isopropylamine, butylamine, ethylenediamine, dipropylamine, octamethylenediamine, octylamine, tetramethylethylenediamine, tridecylamine, 2-ethylhexylamine, tetraethylene pentamine; hexamethylene diamine, dodecyl amine, coco amine, oleylamine, tallow amine, pentadecyl amine, stearyl amine and soya amine.

In another embodiment, the organic amine is an alicyclic amine. Examples of alicyclic amines include, but are not limited to, cyclopentylamine, cyclohexylamine, cycloheptylamine, cyclododecylamine, 4-methylcyclohexylamine, N,N-dimethylcyclohexylamine, hexamethyleneimine, piperidine and isophorone diamine.

In another embodiment, the organic amine is an aryl amine. Examples of aryl amines include, but are not limited to, aniline, diaminotoluene, diphenylalanine, N-phenylbenzamine, and toluidine. In another embodiment, the aryl amine is substituted by a $C_1$-$C_{50}$ group, or a $C_1$-$C_{20}$ alkyl group.

In still another embodiment, the organic amine is an alkyl alkoxylated monoamine containing one amino group that is attached to the terminus of a mono- or polyether backbone. As further discussed below, the mono- or polyether backbone is based on, i.e., further defined by, alkylene oxide groups, such as propylene oxide (PO), ethylene oxide (EO), butylene oxide (BO) and mixtures thereof. In mixed structures, the ratios can be in any desired ratio and may be arranged in blocks (for e.g. repeating or alternating) or randomly distributed. In one non-limiting example, in a mixed EO/PO structure, the ratio of EO:PO can range from about 1:1 to about 1:50 and vice-versa. As such, the alkoxylated monoamine may substantially define a mono- or polyethylene oxide, a mono- or polypropylene oxide, and/or a mono- or polybutylene oxide. The molecular weights of the alkyl alkoxylated monoamines can vary and may range up to a molecular weight of about 6000.

In one particular embodiment, the alkyl alkoxylated monoamine is a compound having a general formula:

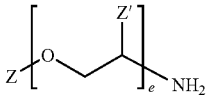

where Z is an alkyl group, an alicyclic group, an aryl group, each Z' is independently hydrogen, methyl or ethyl and e is an integer from about 1 to about 100. In some embodiments, Z is a $C_1$-$C_{40}$ alkyl group or a $C_1$-$C_{20}$ group. In still another embodiment, Z is an aryl group optionally substituted by a $C_1$-$C_{40}$ alkyl group or a $C_1$-$C_{20}$ alkyl group. In still other embodiments, e is an integer from about 1 to about 50 or from about 1 to about 20 or from about 1 to about 15. Particular examples include, but are not limited to compounds having the formulae:

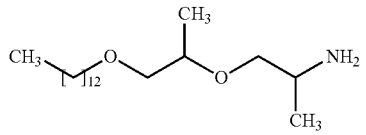

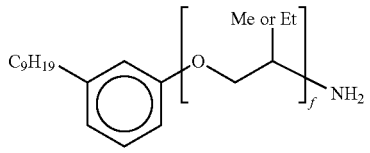

and

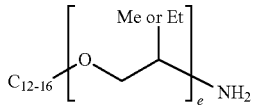

where Me is methyl and Et is ethyl; f is an integer from about 13 to about 14; and e is an integer from about 2 to about 3. Such polyoxyalkylene monoamines included within the above formulas include the JEFFAMINE®: M-600 amine having the formula (1) with a PO/EO mole ratio of 9/1 and a molecular weight of about 600; M-1000 amine having the formula (1) with a PO/EO mole ratio of 3/19 and a molecular weight of about 1000; M-2005 having the formula (1) with a PO/EO mole ratio of 29/6 and a molecular weight of about 2000; M-2070 amine having the formula (1) with a PO/EO mole ratio of 10/31 and a molecular weight of about 2000; FL-1000 amine having the formula (3) where f is 14 and Me or Et is methyl; C-300 amine having the formula (4) where e is about 2.5; XTJ-435 amine having the formula (2); and XTJ-436 amine having the formula (3) where Me or Et is methyl and f is about 13.5.

Depending on the starting materials, the reaction between the organic amine and glycidol may be run at a temperature in the range from about 25° C. to about 300° C. and a pressure from about 1 psi to about 2000 psi for a period of time of about 0.5 hours to 24 hours. In one embodiment, the temperature is maintained in the range from about 125° C. to about 175° C. The reaction may take place having a molar ratio of organic amine to glycidol of about 0.1 to about 2. In another embodiment, the amounts of the organic amine and glycidol are selected to produce at least one reaction product (or compound) having the following formulae:

Amine Mono-Glycidol Reaction Products (5)

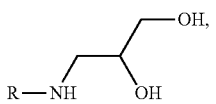

(6)

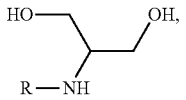

-continued (7)

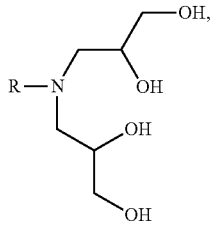

(8)

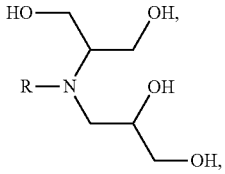

(9)

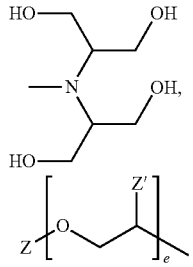

where Z, Z' and e are defined above. In one embodiment, R is a $C_1$-$C_{50}$ alkyl group or a $C_1$-$C_{25}$ alkyl group. In another embodiment, R is a cyclopentyl or cyclohexyl group. In still another embodiment, R is a phenyl group or a phenyl group substituted with a $C_1$-$C_{20}$ alkyl group. In still another embodiment, R is an alkyl alkoxylate group where Z is a $C_1$-$C_{20}$ alkyl group, each Z' is independently hydrogen or methyl and e is an integer from about 1 to about or from about 1 to about 25. Thus, in one embodiment, the friction modifier is selected from a compound having the formula (5), a compound having the formula (6), a compound having the formula (7), a compound having the formula (8), a compound having the formula (9) and a mixture thereof. In one preferred embodiment, the friction modifier comprises at least one of 2,3-dihydroxypropylamine, 1,3-dihydroxypropylamine, Bis(2,3-dihydroxypropyl)amine, Bis(1,3-dihydroxypropyl)amine and (2,3-dihydroxypropyl) (1,3-dihydroxypropyl)amine.

The reaction products of the present disclosure have been found to be surprisingly effective as friction modifiers in a non-aqueous lubricant composition. Thus, the present disclosure also provides a non-aqueous lubricant composition containing a base oil and the friction modifier comprising the reaction product according to the present disclosure.

According to one embodiment, the total amount of base oil incorporated in the non-aqueous lubricant composition may be at least about 50% by weight, or at least 60% by weight, or at least 70% by weight, or at least 80% by weight or at least 90% by weight or at least about 95% by weight, based on the total weight of the non-aqueous lubricant composition.

In another embodiment, the amount of base oil incorporated in the non-aqueous lubricant composition may be in an amount in the range of from about 50% by weight to about 99% by weight, and in other embodiments from about 60% by weight to about 92% by weight, in still other embodiments from about 70% by weight to about 90% by weight, and in further embodiments from about 75% by weight to about 88% by weight, with respect to the total weight of the non-aqueous lubricant composition.

In another embodiment, the total amount of the friction modifier comprising the reaction product of the present disclosure that is incorporated in the non-aqueous lubricant composition is an amount in the range from about 0.0001% by weight to about 20% by weight, and in other embodiments from about 0.001% to about 10% by weight, in still other embodiments from about 0.01% by weight to about 5% by weight, and in further embodiments from about 0.1% by weight to about 1.5% by weight, with respect to the total weight of the non-aqueous lubricant composition.

In some embodiments, the base oil that may be used in the present disclosure includes known synthetic oils and mineral oils and mixtures thereof.

Examples of synthetic oils include alkyl esters of dicarboxylic acids, polyglycols and alcohols, poly-alpha-olefins, including polybutenes, alkyl benzenes, organic esters of phosphoric acids, and polysilicone oils. Synthetic oils include hydrocarbon oils such as polymerized and interpolymerized olefins (e.g., polybutylenes, polypropylenes, propylene isobutylene copolymers, etc.); poly(l-hexenes), poly-(1-octenes), poly(l-decenes), etc. and mixtures thereof; alkylbenzenes (e.g., dodecylbenzenes, tetradecylbenzenes, di-nonylbenzenes, di-(2-ethylhexyl)benzenes, etc.); polyphenyls (e.g., biphenyls, terphenyl, alkylated polyphenyls, etc.); alkylated diphenyl ethers and alkylated diphenyl sulfides and the derivatives, analogs and homologs thereof and the like.

Alkylene oxide polymers and interpolymers and derivatives thereof where the terminal hydroxyl groups have been modified by esterification, etherification, etc., constitute another class of known synthetic oils that may be used. Such oils are exemplified by the oils prepared through polymerization of ethylene oxide or propylene oxide, the alkyl and aryl ethers of these polyoxyalkylene polymers (e.g., methylpolyisopropylene glycol ether having an average molecular weight of about 1000, diphenyl ether of polyethylene glycol having a molecular weight of about 500-1000, diethyl ether of polypropylene glycol having a molecular weight of about 1000-1500, etc.) or mono- and polycarboxylic esters thereof, for example, the acetic acid esters, mixed $C_3$-$C_8$ fatty acid esters, or the oxo-acid diester of tetraethylene glycol.

Another class of synthetic oils that may be used include the esters of dicarboxylic acids (e.g., phthalic acid, succinic acid, alkyl succinic acids, alkenyl succinic acids, maleic acid, azelaic acid, suberic acid, sebacic acid, fumaric acid, adipic acid, linoleic acid dimer, malonic acid, alkyl malonic acids, alkenyl malonic acids, etc.) with a variety of alcohols (e.g., butyl alcohol, hexyl alcohol, dodecyl alcohol, 2-ethylhexyl alcohol, ethylene glycol, diethylene glycol monoether, propylene glycol, etc.). Specific examples of these esters include dibutyl adipate, di-)(2-ethylhexyl)sebacate, di-n-hexyl fumarate, dioctyl sebacate, diisooctyl azelate, diisodecyl azelate, dioctyl phthalate, didecyl phthalate, dieicosyl sebacate, the 2-ethylhexyl diester of linoleic acid dimer, the complex ester formed by reacting one mole of sebacic acid with two moles of tetraethylene glycol and two moles of 2-ethylhexanoic acid and the like.

Esters useful as synthetic oils also include those made from $C_5$ to $C_{12}$ monocarboxylic acids and polyols and polyol ethers such as neopentyl glycol, trimethylol propane, pentaerythritol, dipentaerythritol, tripentaerythritol, etc.

The base oil may contain a minor amount or major amount of a poly-alpha-olefin (PAO). Typically, the poly-alpha-olefins are derived from monomers having from about 4 to about 30, or from about 4 to about 20 or from about 6 to about 16 carbon atoms. Examples of useful PAOs include those derived from octene, decene, mixtures thereof, and the like. PAOs may have a viscosity of from about 2 to about 15 centistoke (cSt), or from about 3 to about 12 cSt, or from about 4 to about 8 cSt, at 100° C. Examples of PAOs include 4 cSt at 100° C. poly-alpha-olefins, 6 cSt at 100° C. poly-alpha-olefins, and mixtures thereof. Mixtures of mineral oil with the foregoing PAO's may be used.

The base oil may be an oil derived from Fischer-Tropsch synthesized hydrocarbons. Fischer-Tropsch synthesized hydrocarbons are made from synthesis gas containing $H_2$ and CO using a Fischer-Tropsch catalyst. Such hydrocarbons typically require further processing in order to be useful as the base oil. For example, the hydrocarbons may be hydroisomerized using processes disclosed in U.S. Pat. Nos. 6,103,099 or 6,180,575; hydrocracked and hydroisomerized using processes disclosed in U.S. Pat. Nos. 4,943,672 or 6,096,940; dewaxed using processes disclosed in U.S. Pat. No. 5,882,505; or hydroisomerized and dewaxed using processes disclosed in U.S. Pat. Nos. 6,013,171; 6,080,301; or 6,165,949.

Unrefined, refined, and rerefined oils, either mineral or synthetic (as well as mixtures of two or more of any of these) of the type disclosed herein can be used in the base oils. Unrefined oils are those obtained directly from a natural or synthetic source without further purification treatment. For example, a shale oil obtained directly from retorting operations, a petroleum oil obtained directly from primary distillation or ester oil obtained directly from an esterification process and used without further treatment would be an unrefined oil. Refined oils are similar to the unrefined oils except they have been further treated in one or more purification steps to improve one or more properties. Many such purification techniques are known to those skilled in the art such as solvent extraction, secondary distillation, acid or base extraction, filtration, percolation, etc. Rerefined oils are obtained by processes similar to those used to obtain refined oils applied to refined oils which have already been used in service. Such rerefined oils are also known as reclaimed or reprocessed oils and often are additionally processed by techniques directed to removal of spent additives, contaminants and oil breakdown products.

Mineral oils include liquid petroleum oils and solvent-treated or acid-treated mineral lubricating oil of the paraffinic, naphthenic, or mixed paraffinic/naphthenic type which may be further refined by hydrofinishing processes and/or dewaxing.

Naphthenic base oils have a low viscosity index (VI) (generally 40-80) and a low pour point. Such base oils are produced from feedstock rich in naphthene and low in wax content and are used mainly for lubricants in which color and color stability are important and VI and oxidation stability are of secondary importance.

Paraffinic base oils have a higher VI (generally >95) and a high pour point. These base oils are produced from feedstock rich in paraffin, and are used for lubricants in which VI and oxidation stability are important.

In some embodiments, the base oil is constituted from mineral oils and/or synthetic oils containing more than 80% by weight of saturates, and in other embodiments more than 90% by weight, as measured according to ASTM D2007. In other embodiments, the base oil contains less than 1.0% by weight, and in still other embodiments less than 0.1% by weight of sulphur, calculated as elemental sulphur and measured according to ASTM D2622, ASTM D4294, ASTM D4927 or ASTM D3120.

As one skilled in the art would readily appreciate, the viscosity of the base oil is dependent upon the application. Accordingly, the viscosity of a base oil for use herein may ordinarily range from about 2 cSt to about 2000 cSt at 100° C. Generally, individually the base oils used as engine oils will have a kinematic viscosity range at 100° C. of about 2 cSt to about cSt, in some embodiments about 3 cSt to about 16 cSt, and other embodiments about 4 cSt to about 12 cSt and will be selected or blended depending on the desired end use and the additives in the finished oil to give the desired grade of engine oil, e.g., a lubricant composition having an Society of Automotive Engineers (SAE) Viscosity Grade of OW, OW-20, OW-30, OW-40, OW-50, OW-60, 5W, 5W-20, 5W-30, 5W-40, 5W-50, 5W-60, 10W, 1 OW-20, 10W-30, 1 OW-40, 1 OW-50, 15W, 15W-20, 15W-30 or 15W-40. Base oils used as gear oils may have viscosities ranging from about 2 cSt to about 2000 cSt at 100° C.

The non-aqueous lubricant compositions may be used in the lubrication of essentially any spark-ignited or compression-ignited internal composition engine, including automobile and truck engines, two cycle engines, diesel engines, aviation piston engines, marine and railroad engines and the like. Also contemplated are non-aqueous lubricant compositions for gas fired engines, alcohol (e.g. methanol) powered engines, stationary powered engines, turbines and the like. The non-aqueous lubricant composition may also be used as an automatic transmission fluid, gear lubricant, compressor lubricant, metal-working lubricant or hydraulic fluid.

The non-aqueous lubricant composition may further comprise additional additives, such as anti-oxidants, anti-wear additives, detergents, dispersants, a second friction modifier that may comprise one or more other friction modifiers, viscosity index improvers, pour point depressants, corrosion inhibitors, defoaming agents and seal fix or seal compatibility agents and mixtures thereof. A sampling of these additives can be found in, for example, U.S. Pat. Nos. 5,498,809 and 7,696,136, the relevant portions of each disclosure are incorporated herein by reference, although one skilled in the art is well aware that this comprises only a partial list of available lubricant additives. It is also well known that one additive may be capable of providing or improving more than one property, e.g., an anti-wear agent may also function as an anti-fatigue and/or an extreme pressure additive.

Antioxidants that may be conveniently used include those selected from the group of aminic antioxidants and/or phenolic antioxidants. In one embodiment, the antioxidants are present in an amount in the range of from 0.1% by weight to about 5.0% by weight, while in other embodiments from an amount in the range of from 0.3% by weight to about 3.0% by weight, based on the total weight of the non-aqueous lubricant composition.

Examples of aminic antioxidants which may be conveniently used include alkylated diphenylamines, phenyl-α-naphthylamines, phenyl-p-naphthylamines and alkylated a-naphthylamines.

In one embodiment, the aminic antioxidants include dialkyldiphenylamines such as p,p'-dioctyl-diphenylamine, p,p'-di-a-methylbenzyl-diphenylamine and N-p-butylphenyl-N-p'-octylphenylamine, monoalkyldiphenylamines such as mono-t-butyldiphenylamine and mono-octyldiphenylamine, bis(dialkylphenyl)amines such as di-(2,4-diethylphenyl) amine and di(2-ethyl-4-nonylphenyl)amine, alkylphenyl-1-naphthylamines such as octylphenyl-1-naphthylamine and n-t-dodecylphenyl-1-naphthylamine, 1-naphthylamine, arylnaphthylamines such as phenyl-1-naphthylamine, phenyl-2-naphthylamine, N-hexylphenyl-2-naphthylamine and N-octylphenyl-2-naphthylamine, phenylenediamines such as N,N'-diisopropyl-p-phenylenediamine and N,N'-diphenyl-p-phenylenediamine, and phenothiazines, such as phenothiazine and 3,7-dioctylphenothiazine.

Examples of phenolic antioxidants which may be conveniently used include $C_7$-$C_9$ branched alkyl esters of 3,5-bis (1,1-dimethyl-ethyl)-4-hydroxy-benzenepropanoic acid, 2-t-butylphenol, 2-t-butyl-4-methylphenol, 2-t-butyl-5-methylphenol, 2,4-di-t-butylphenol, 2,4-dimethyl-6-t-butylphenol, 2-t-butyl-4-methoxyphenol, 3-t-butyl-4-methoxyphenol, 2,5-di-t-butylhydroquinone, 2,6-di-t-butyl-4-alkylphenols such as 2,6-di-t-butylphenol, 2,6-di-t-butyl-4-methylphenol and 2,6-di-t-butyl-4-ethylphenol, 2,6-di-t-butyl-4-alkoxyphenols such as 2,6-di-t-butyl-4-methoxyphenol and 2,6-di-t-butyl-4-ethoxyphenol, 3,5-di-t-butyl-4-hydroxybenzylmercaptooctylacetate, alkyl-3-(3,5-di-t-butyl-A-hydroxyphenyl)propionates such as n-octadecyl-3-(3,5-di-t-butyl-4-hydroxyphenyl)propionate, n-butyl-3-(3,5-di-t-butyl-4-hydroxyphenyl)propionate and 2'-ethylhexyl-3-(3,5-di-t-butyl-4-hydroxyphenyl)propionate, 2, 6-d-t-butyl-a-dimethylamino-p-cresol, 2,2'-methylenebis(4-alkyl-6-t-butylphenol) such as 2,2'-methylenebis (4-methyl-6-t-butylphenol, and 2,2-methylenebis(4-ethyl-6-t-butylphenol), bisphenols such as 4,4'-butylidenebis(3-methyl-6-t-butylphenol, 4,4'-methylenebis(2,6-di-t-butylphenol), 4,4'-bis(2,6-di-t-butylphenol), 2,2-(di-p-hydroxyphenyl)propane, 2,2-bis(3,5-di-t-butyl-4-hydroxyphenyl)propane, 4,4'-cyclohexylidenebis(2,6-t-butylphenol), hexamethyleneglycol-bis [3-(3,5-di-t-butyl-4-hydroxyphenyl)propionate], triethyleneglycolbis[3-(3-t-butyl-4-hydroxy-5-methylphenyl)propionate], [diethyl-3-(3, 5-di-t-butyl-4-hydroxyphenyl)propionate], 3, 9-bis [1, 1-dimethyl-2-[3-(3-t-butyl-4-hydroxy-5-methylphenyl)-propionyloxy]ethyl]2,4, 8, 10-tetraoxaspiro[5,5]undecane, 4,4'-thiobis(3-methyl-6-t-butylphenol) and 2,21-thiobis(4,6-di-t-butylresorcinol), polyphenols such as tetralds[methylene-3-(3,5-di-t-butyl-4-hydroxyphenyl)propionate]m ethane, 1, 1,3-tris(2-methyl-4-hydroxy-5-t-butylphenyl)butane, 1,3,5-trim ethyl-2,4,6-tris(3, 5-di-t-butyl-4-hydroxybenzyl) benzene, bis-[3,3'-bis(4'-hydroxy-3'-t-butylphenyl)butyric acid]glycol ester, 2-(3',5'-di-t-butyl-4-hydroxyphenyl) methyl-4-(2",4"-di-t-butyl-3"-hydroxyphenyl)methyl-6-t-butylphenol and 2,6-bis(2'-hydroxy-3'-t-butyl-5'-methylbenzyl)-4-methylphenol, and p-t-butylphenol-formaldehyde condensates and p-t-butylphenol-acetaldehyde condensates.

In another embodiment, the non-aqueous lubricant composition may comprise a single zinc dithiophosphate or a combination of two or more zinc dithiophosphates as anti-wear additives, each zinc dithiophosphate being selected from zinc dialkyl-, diaryl- or alkylaryl-dithiophosphates. The non-aqueous lubricant composition may generally comprise in the range of from about 0.4% by weight to about 1.0% by weight of zinc dithiophosphate, based on total weight of the non-aqueous lubricant composition. Additional or alternative known anti-wear additives may also be conveniently used in the non-aqueous lubricant composition.

Detergents that may be used in the non-aqueous lubricant composition include one or more salicylate and/or phenate and/or sulphonate detergents. However, as metal organic and inorganic base salts that are used as detergents can contribute to the sulphated ash content of a non-aqueous lubricant composition, in one embodiment the amounts of such additives are minimized. Furthermore, in order to maintain a low sulphur level, salicylate detergents are preferred. Thus, in one embodiment, the non-aqueous lubricant composition may comprise one or more salicylate detergents. The detergents may be used in amounts in the range of about 0.05% by weight to about 12.5% by weight, in some embodiments from about 1.0% by weight to about 9.0% by weight and in other embodiments in the range of from about 2.0% by weight to about 5.0% by weight, based on the total weight of the non-aqueous lubricant composition.

A second friction modifier, which may include one or more additional friction modifiers, may be used, including metal based friction modifiers comprising one or more organo molybdenum compounds such as, for example, molybdenum dialkyldithiocarbamates, molybdenum dialkyl dithiophosphates, molybdenum disulfide, tri-molybdenum cluster dialkyldithiocarbamates, non-sulfur molybdenum compounds and the like; for example, a molybdenum dialkyldithiocarbamate friction modifier may be present. Many of these molybdenum compounds are well known and many are commercially available. Second friction modifiers that may also be present, include organic fatty acids and derivatives of organic fatty acids, amides, imides, and other organo metallic species, for example, zinc and boron compounds, etc. The amounts of these second friction modifiers that may be added to the non-aqueous lubricant composition in a range from about 0.001% by weight to about 5% by weight, based on the total weight of the non-aqueous lubricant composition.

The non-aqueous lubricant compositions of the present disclosure may additionally contain an ash-free dispersant which may be admixed in an amount in the range from about 5% by weight to about 15% by weight, based on the total weight of the non-aqueous lubricant composition.

Examples of ash-free dispersants which may be used include the polyalkenyl succinimides and polyalkenyl succinic acid esters. In one embodiment, the ash-free dispersant includes borated succinimides.

Examples of viscosity index improvers which may conveniently be used in the non-aqueous lubricant composition of the present disclosure include the styrene-butadiene copolymers, styrene-isoprene stellate copolymers and the polymethacrylate copolymer and ethylene-propylene copolymers. Such viscosity index improvers may be conveniently employed in an amount in the range of from about 1% by weight to about 20% by weight, based on the total weight of the non-aqueous lubricant composition.

Polymethacrylates may be conveniently employed in the non-aqueous lubricant compositions of the present invention as effective pour point depressants.

Furthermore, compounds such as alkenyl succinic acid or ester moieties thereof, benzotriazole-based compounds and thiodiazole-based compounds may be conveniently used in the non-aqueous lubricant composition of the present disclosure as corrosion inhibitors.

Compounds such as polysiloxanes, dimethyl polycyclohexane and polyacrylates may be conveniently used in the non-aqueous lubricant composition of the present disclosure as defoaming agents.

Compounds which may be conveniently used in the non-aqueous lubricant composition of the present disclosure as seal fix or seal compatibility agents include, for example, commercially available aromatic esters.

As noted above, the non-aqueous lubricant compositions may contain any number of these additives. Thus, in some embodiments, final non-aqueous lubricant compositions of this disclosure will generally contain a combination of additives, including the reaction product according to the present disclosure along with other common additives, in a combined concentration ranging from about 0.1% by weight to about 30% by weight, for example, from about 0.5% by weight to about 10% by weight, based on the total weight of the non-aqueous lubricant composition. In other embodiments, the combined reaction product and additives are present from about 1% by weight to about 5% by weight, based on the total weight of the non-aqueous lubricant composition. Oil concentrates of the reaction product and additives can contain from about 30% by weight to about 75% by weight additives, based on the total weight of the non-aqueous lubricant composition.

According to another embodiment, there is provided a non-aqueous lubricant composition comprising: A) from about 70% by weight to about 99.9% by weight of a base oil, based on the total weight of the non-aqueous lubricant composition; B) a friction modifier as disclosed herein; and C) one or more additional additives, wherein the combined amount of B) and C) present in the composition is from about 0.1% by weight to about 30% by weight, based on the total weight of the non-aqueous lubricant composition.

In another embodiment the base oil may be present in an amount from about 90% by weight to about 99.5% by weight and the combined amount of B) and C) is from about 0.5% by weight to about 10% by weight; and in another embodiment, the base oil is present in an amount from about 95% by weight to about 99% by weight and the combined amount of B) and C) is from about 1% by weight to about 5% by weight, based on the total weight of the non-aqueous lubricant composition.

The friction modifier comprising the reaction product of the present disclosure can be added directly to the base oil by itself or in combination with one or more additives. Thus, in one embodiment, there is provided a friction reducing additive package comprising the friction modifier comprising the reaction product of the present disclosure and one or more additives. It is also possible to add the friction modifier comprising the reaction product of the present disclosure to a preformulated non-aqueous lubricant composition which already contains all or most of the other formulation components and additives.

Because of the surprisingly improved friction reducing properties exhibited by the friction modifier comprising the reaction product of the present disclosure, the non-aqueous lubricant compositions of this disclosure can be employed to improve fuel economy for gas and diesel engines. Thus, there is also provided a method for improving the friction reducing properties of a non-aqueous lubricant composition by adding the friction modifier comprising the reaction product of the present disclosure to the non-aqueous lubricant and, correspondingly, a method for reducing friction between sliding parts of an engine by contacting the engine with the non-aqueous lubricant composition of the present disclosure. In some embodiments, the sliding parts may be piston rings/cylinder liners, bearings of crankshafts and connecting rods and valve mechanisms including cams and valve lifters.

In still another embodiment, the friction modifier (and optionally one or more additives above) may be added to petroleum distillate fuels such, but not limited to, gasoline, diesel and the like, to form a lubricating composition for lubricating sliding parts the non-aqueous lubricant composition cannot reach. In such embodiments, the petroleum distillate fuels, such as gasoline fuels, may also include antiknock agents, such as methylcyclopentadienyl manganese tricarbonyl, tetramethyl, or tetraethyl lead, or other dispersants or detergents such as various substituted succinimides, amines, etc. The lubricant compositions may be readily prepared by, for example, dispersing the friction modifier comprising the reaction product of the present disclosure in a selected petroleum distillate fuel as by adding the friction modifier to a petroleum distillate and stirring or otherwise agitating the resulting solution to evenly disperse the reaction product in the composition. In this regard, any of the conventional methods of blending fuels may be employed. The amount of friction modifier comprising the reaction product of the present disclosure dispersed in the fuel may range from about 0.1% by weight to about 30% by weight, for example, from greater than about 0.5% by weight to about 10% by weight, based on the total weight of the lubricant composition. In other embodiments, the combined amount of the friction modifier is present from about 1% by weight to about 5% by weight based on the total weight of the lubricant composition.

The present disclosure will now be further described with reference to the following non-limiting examples.

EXAMPLES

Example 1

A tallow amine was reacted with glycidol to make two reaction products (FM-A and FM-B). The reaction was performed by adding glycidol to the tallow amine at 150° C. with 4 hours digestion time after the addition. The two reaction products which were made from tallow amine glycidol ring open reactions, are listed in the following table:

| | FM-A | FM-B |
|---|---|---|
| Residual tallow amine | 41.1% by weight | 0 |
| Amine mono-glycidol add-up | 30.8% by weight | 62.2% by weight |
| Amine Di-glycidol add-up | 28.2% by weight | 37.8% by weight |

An alkyl alkoxylated monoamine was next reacted with glycidol to make the two additional reaction products (FM-C and FM-D). The structure of the alkyl alkoxylated monoamine had the formula

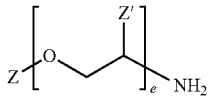

where Z is a $C_{12}$-$C_{14}$ alkyl group, Z' is a methyl group and e is an integer having an average from about 2 to about 5. The reaction was performed by adding glycidol to the alkyl alkoxylated monoamine at 150° C. with 4 hours digestion time after the addition. The two reaction products which were made from the alkyl alkoxylated monoamine glycidol ring open reactions, are listed in the following table:

| | FM-C | FM-D |
|---|---|---|
| Residual alkyl alkoxylated monoamine | 2.3% by weight | 0.1% by weight |
| Amine mono-glycidol add-up | 75.2% by weight | 15.3% by weight |
| Amine Di-glycidol add-up | 22.5% by weight | 84.6% by weight |

The coefficient of frictions of commercial oils and further comprising 0.5% of the reaction products above were then determined at 100° C. and 130° C. using a Mini Traction Machine with a ¾ inch ball on a smooth disc. The load applied was 36N (1 GPa contact pressure) and the speed of rotation was from 0.01 m/s to 2 m/s. The results at 130° C. are shown in Tables 1 and 2 below:

TABLE 1

Results at 130° C. in Mobil 1 5W-30 oil

| FM Speed (m/s) | No FM Friction coeff. | FM-A Friction coeff. | FM-B Friction coeff. | FM-C Friction coeff. | FM-D Friction coeff. |
|---|---|---|---|---|---|
| 0.024 | 0.1028 | 0.0717 | 0.0702 | 0.081 | 0.0737 |
| 0.01 | 0.1114 | 0.07 | 0.0656 | 0.0757 | 0.0738 |

TABLE 2

Results at 130° C. in Pennzoil 0W-20 oil

| FM Speed (m/s) | No FM Friction coeff. | FM-A Friction coeff. | FM-B Friction coeff. | FM-C Friction coeff. | FM-D Friction coeff. |
|---|---|---|---|---|---|
| 0.02 | 0.1133 | 0.0788 | 0.0762 | 0.0917 | 0.0912 |
| 0.01 | 0.1102 | 0.0762 | 0.0763 | 0.0931 | 0.0938 |

Figure 2:
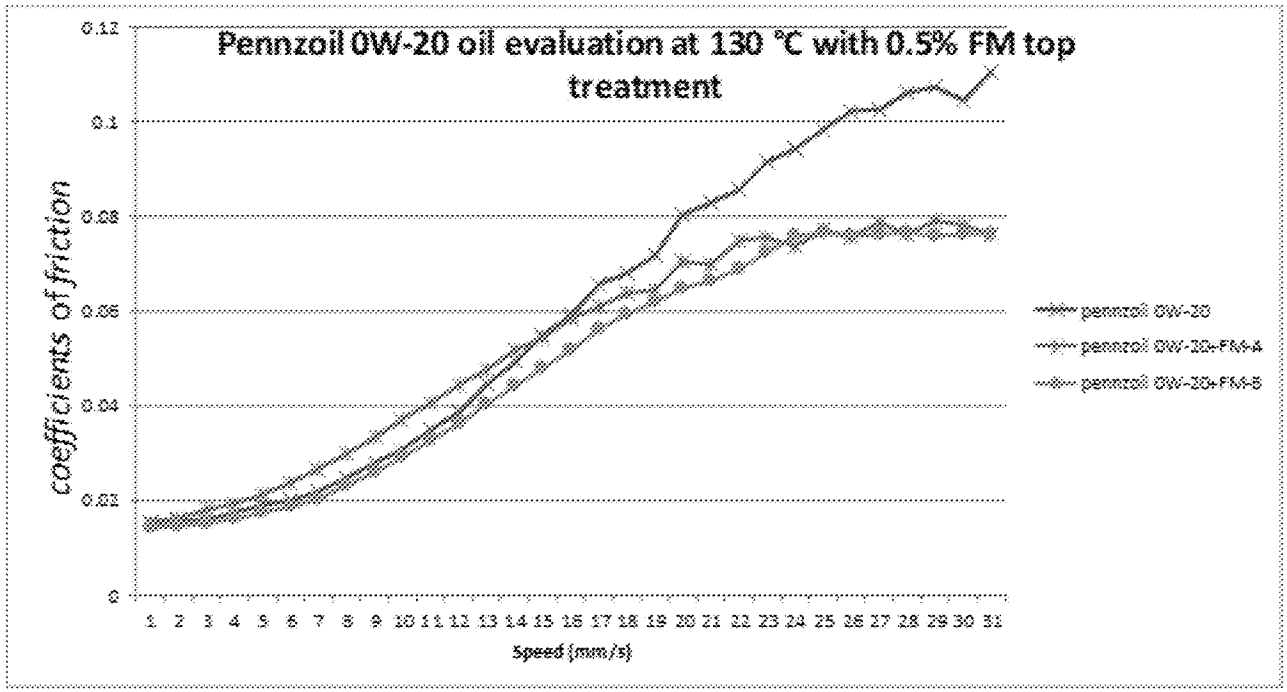

The results in Tables 1 and 2 demonstrate that the inventive friction modifier comprising the reaction products (FM-A, B, C and D) can significantly reduce the coefficients of friction of the Mobil 1 5W-30 oil and Pennzoil OW-20 oil. To better present the results, the whole range of the friction coefficients for FM-A and B are shown in FIGS. 1 and 2.

Because the inventive reaction products contain multiple OH groups in the polar head, the reactions products can strongly adsorb to the surface. The linear structure of the hydrophobic tail in FM-A, B, C and D makes the reaction products capable of lining up on the surface well with strong Van der Waals forces between their tails. These unique molecular structures make these reaction products excellent friction modifiers in the oils.

What is claimed is:

1. A non-aqueous lubricant composition comprising a base oil and a friction modifier comprising a reaction product of: (i) an alkyl alkoxylated amine having the formula

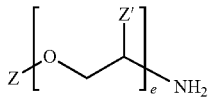

where Z is a $C_1$-$C_{30}$ alkyl group or an alicyclic group or an aryl group, each Z' is independently hydrogen, methyl or ethyl and e is an integer from about 1 to about 100; (ii) glycidol; and optionally a second organic amine selected from an alkyl amine, an alicyclic amine, an aryl amine, an alkyl alkoxylated monoamine.

2. The non-aqueous lubricant composition of claim 1, wherein the second organic amine is an alkyl amine having the formula $N(R_1)_3$ where each $R_1$ is hydrogen or a $C_1$-$C_{50}$ alkyl group with the proviso that at least one $R_1$ is hydrogen.

3. The non-aqueous lubricant composition of claim 2, wherein the second organic amine is an alicyclic amine selected from cyclopentylamine, cyclohexylamine; cycloheptylamine; cyclododecylamine; 4-methylcyclohexylamine, N,N-dimethylcyclohexylamine; hexamethyleneimine, piperidine and isophorone diamine.

4. The non-aqueous lubricant composition of claim 1, wherein the second organic amine is an aryl amine substituted with a $C_1$-$C_{20}$ alkyl group.

5. The non-aqueous lubricant composition of claim 1, wherein Z is a $C_1$-$C_{30}$ alkyl group.

6. The non-aqueous lubricant composition of claim 1, wherein the friction modifier is present in an amount in the range of about 0.1% by weight to about 1.5% by weight, based on the total weight of the non-aqueous lubricant composition.

7. The non-aqueous lubricant composition of claim 1, wherein the base oil is a synthetic oil.

8. The non-aqueous lubricant composition of claim 1, wherein the base oil is a mineral oil.

9. A method for reducing friction between sliding parts of an engine by contacting the engine with the non-aqueous lubricant composition of claim 1.

10. A friction reducing additive package comprising the friction modifier of claim 1 and one or more additives selected from an anti-oxidant, an anti-wear additive, a detergent, a dispersant, a second friction modifier, a viscosity index improver, a pour point depressant, a corrosion inhibitor, a defoaming agent, a seal fix, a seal compatibility agent and mixtures thereof.

11. A non-aqueous lubricant composition comprising a base oil and a friction modifier comprising a compound having a formula:

(5)

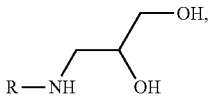

(6)

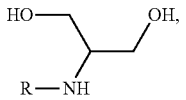

(7)

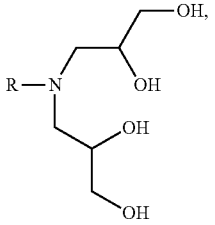

-continued (8)

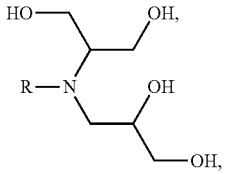

(9)

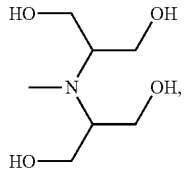

wherein R is an alkyl alkoxylate group having the formula

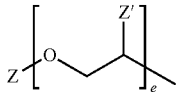

where Z is an alkyl group, an alicyclic group, an aryl group, each Z' is independently hydrogen, methyl or ethyl and e is an integer from about 1 to about 100.

12. The non-aqueous lubricant composition of claim 11, further comprising a second friction modifier compound wherein R is a $C_1$-$C_{25}$ alkyl group.

13. The non-aqueous lubricant composition of claim 11, further comprising a second friction modifier compound wherein R is a phenyl group or a phenyl group substituted with a $C_1$-$C_{20}$ alkyl group.

14. The non-aqueous lubricant composition of claim 11, wherein R is an alkyl alkoxylate group where Z is a $C_1$-$C_{20}$ alkyl group, each Z' is independently hydrogen or methyl and e is an integer from about 1 to about 25.

15. The non-aqueous composition of claim 11, wherein the second friction modifier comprises at least one of 2,3-dihydroxypropylamine, 1,3-dihydroxypropylamine, Bis(2,3-dihydroxypropyl)amine, Bis(1,3-dihydroxypropyl) amine or (2,3-dihydroxypropyl) (1,3-dihydroxypropyl) amine.

* * * * *